US011395504B2

(12) United States Patent
Mocelin et al.

(10) Patent No.: US 11,395,504 B2
(45) Date of Patent: Jul. 26, 2022

(54) APPARATUS AND METHOD FOR CONDITIONING TOBACCO

(71) Applicant: BRITISH AMERICAN TOBACCO (INVESTMENTS) LIMITED, London (GB)

(72) Inventors: Riscala Mocelin, Cachoeirinha (BR); Jaime Menegasso, Cachoeirinha (BR); Valdir Milak, Cachoeirinha (BR); Irving Joseph Berger, Cachoeirinha (BR); Paula Fabiane Martins, Cachoeirinha (BR); Vando Braz De Oliveira, Cachoeirinha (BR)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 0 days.

(21) Appl. No.: 16/061,566

(22) PCT Filed: Nov. 22, 2016

(86) PCT No.: PCT/GB2016/053630
§ 371 (c)(1),
(2) Date: Jun. 12, 2018

(87) PCT Pub. No.: WO2017/103560
PCT Pub. Date: Jun. 22, 2017

(65) Prior Publication Data

US 2018/0368466 A1 Dec. 27, 2018

(30) Foreign Application Priority Data

Dec. 17, 2015 (GB) ..... 1522277

(51) Int. Cl.
*A24B 3/04* (2006.01)
*A24B 9/00* (2006.01)
*A24B 1/02* (2006.01)

(52) U.S. Cl.
CPC ..... *A24B 9/00* (2013.01); *A24B 1/02* (2013.01); *A24B 3/04* (2013.01)

(58) Field of Classification Search
CPC ..... A24B 1/00–10; A24B 3/00–18; A24B 3/04; A24B 9/00
See application file for complete search history.

(56) References Cited

U.S. PATENT DOCUMENTS 2,343,346 A * 3/1944 Touton ..... A24B 1/02 34/224
3,233,339 A 2/1966 Long et al.
(Continued)

FOREIGN PATENT DOCUMENTS

BR 3201451 A 7/1982
CN 2111651 U 8/1992
(Continued)

OTHER PUBLICATIONS

CN102524921 (Machine Translation) [online], [retrieved on Feb. 12, 2020], retrieved from espacenet (https://worldwide.espacenet.com/patent/) (Year: 2012).*
(Continued)

*Primary Examiner* — Michael J Felton
*Assistant Examiner* — Yana B Krinker
(74) *Attorney, Agent, or Firm* — McKee, Voorhees & Sease, PLC

(57) ABSTRACT

The present invention is in the field of tobacco conditioning, which is performed generally after curing and before baling. It has been identified that cured tobacco is very brittle and difficult to handle without damaging the tobacco leaf. In
(Continued)

order to address this issue an apparatus for post-curing conditioning of tobacco is provided. The apparatus includes a tobacco chamber for storing cured tobacco leaves for conditioning; and an air processing facility which includes: a ventilation system for creating an airflow through the apparatus, wherein said airflow is drawn into the air processing facility, passes from the air processing facility into the tobacco chamber, and subsequently exits the apparatus; a heater for adding heat to the airflow; and a humidity generator for adding moisture to the airflow.

14 Claims, 2 Drawing Sheets

(56) References Cited

U.S. PATENT DOCUMENTS

| | | | | | |
|---|---|---|---|---|---|
| 3,906,961 | A | | 9/1975 | Rowell et al. | |
| 4,011,041 | A | | 3/1977 | Taylor | |
| 4,114,288 | A | | 9/1978 | Fowler | |
| 4,263,721 | A | | 4/1981 | Danford | |
| 4,499,911 | A | | 2/1985 | Johnson | |
| 4,640,299 | A | * | 2/1987 | Ono | F26B 21/06 131/303 |
| 5,018,281 | A | | 5/1991 | Bulluck, Jr. | |

FOREIGN PATENT DOCUMENTS

| | | | | | |
|---|---|---|---|---|---|
| CN | 102524921 | | * | 7/2012 | A24B 3/04 |
| CN | 102524921 | A | | 7/2012 | |
| CN | 202286266 | U | | 7/2012 | |
| CN | 202476421 | U | | 10/2012 | |
| CN | 102960842 | A | | 3/2013 | |
| CN | 103162524 | A | | 6/2013 | |
| CN | 203037009 | U | | 7/2013 | |
| CN | 203037010 | U | | 7/2013 | |
| CN | 203523792 | | * | 4/2014 | A24B 3/04 |
| CN | 103908006 | A | | 7/2014 | |
| DE | 2402538 | A1 | | 7/1975 | |
| JP | H06327451 | A | | 11/1994 | |
| JP | H07289226 | A | | 11/1995 | |
| JP | 201577071 | A | | 4/2015 | |
| WO | 8907401 | A1 | | 8/1989 | |
| WO | 2012026950 | A1 | | 3/2012 | |
| WO | WO-2013180918 | A1 | * | 12/2013 | A24B 1/02 |
| WO | 2017/103560 | A1 | | 6/2017 | |

OTHER PUBLICATIONS

CN203523792 (Machine Translation) [online], [retrieved on Feb. 12, 2020], retrieved from espacenet (https://worldwide.espacenet.com/patent/) (Year: 2014).*

* cited by examiner

APPARATUS AND METHOD FOR CONDITIONING TOBACCO

CROSS-REFERENCE TO RELATED APPLICATIONS

This application is the National Stage of International Application No. PCT/GB2016/053630, filed Nov. 22, 2016, which claims priority to and benefit of Great Britain Patent Application No. 1522277.1, filed Dec. 17, 2015, all of which are herein incorporated by reference in their entirety for all purposes.

FIELD

The present invention relates to an apparatus and method for conditioning tobacco after curing.

BACKGROUND

Once tobacco plants have been harvested the leaves are removed, separated and placed into a barn for drying and curing. After curing, the leaves are subsequently conditioned and then packed into bundles or bales for storage or transportation to industry for manufacture into products such as cigars or cigarettes.

The above processing of tobacco is often carried out under humid weather conditions. One benefit of the humidity is that it tends to soften the leaves, which can make them more pliant, i.e. less brittle and liable to damage, during the handling of the tobacco. Indeed, a common procedure for many producers is to spray water onto the leaves as part of the processing if they lack the desired softness.

On the other hand, an excess of moisture may impair the quality and conservation of the tobacco leaves. For example, an excess of moisture may result in serious damage to the final product quality including: fermentation, mould, loss of aroma and distinctive taste, and other chemical changes in the tobacco. The Brazilian Ministry of Agriculture has issued an Ordinance that recommends a moisture level of no more than approximately 17%. However, processed tobacco may end up exceeding this recommended moisture level, for example, because the tobacco has been processed in air of high relative humidity, and/or because additional water has been sprayed onto the tobacco, especially if the amount of sprayed water is high, and/or if the spraying has not been uniform.

SUMMARY

Aspects of the invention are defined in the accompanying claims.

According to a first aspect there is provided an apparatus for conditioning of tobacco leaves including a tobacco chamber for storing cured tobacco leaves for conditioning; and an air processing facility. The air processing facility includes a ventilation system for creating an airflow through the apparatus, a heater for adding heat to the airflow; and a humidity generator for adding moisture to the airflow. The airflow is drawn into the air processing facility, passes from the air processing facility into the tobacco chamber, and subsequently exits the apparatus. The apparatus is thus able to condition the tobacco leaves in the chamber to a desired moisture level by using the heater to add heat to the airflow if the moisture level of the tobacco leaves in the chamber is above said desired moisture level, and to add moisture to the airflow if the moisture level of the tobacco leaves in the chamber is below said desired moisture level.

According to a second aspect there is provided a method for conditioning of tobacco leaves including the steps of: introducing tobacco leaves to a tobacco chamber; using a ventilation system to draw air into an air processing facility and pass the air from the air processing facility through the tobacco chamber; heating the airflow if the moisture level of the tobacco leaves in the chamber is above a desired moisture level and using a humidity generator to add moisture to the airflow if the moisture level of the tobacco leaves in the chamber is below the desired moisture level.

The present disclosure helps to control accurately the moisture content of tobacco during conditioning, which is generally performed after curing but before baling, thereby avoiding a situation where, on the one hand, the tobacco which has been dried is overly brittle, resulting in the tobacco being very difficult to handle and bale for transportation, or on the other hand, the tobacco retains too much moisture, and therefore is susceptible to problems such as mould or fermentation.

DESCRIPTION OF DRAWINGS

The present teachings will now be described by way of example only with reference to the following figures in which like parts are depicted by like reference numerals.

Figure 1:
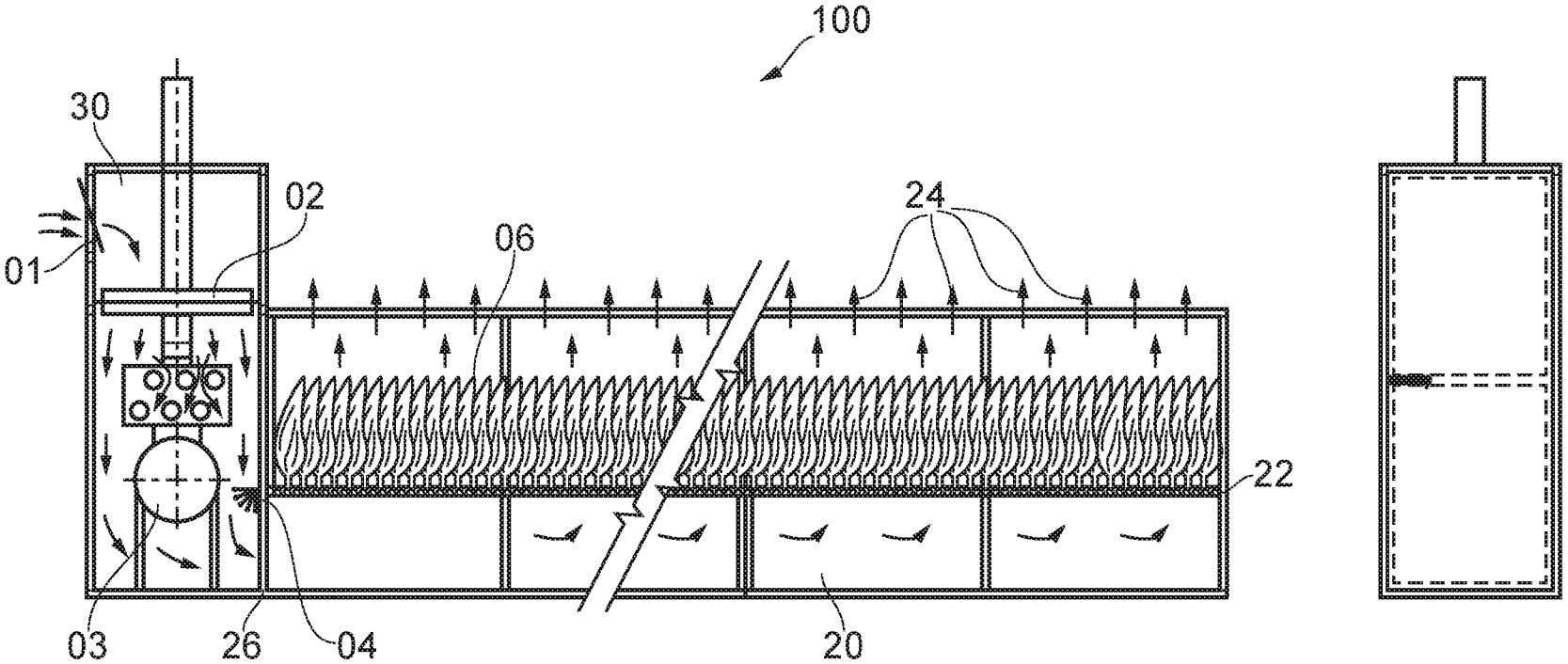
FIG. 1 is a side view of an apparatus for conditioning tobacco in accordance with some embodiments of the invention.

While the invention is susceptible to various modifications and alternative forms, specific embodiments are shown by way of example in the drawings and are herein described in detail. It should be understood, however, that the drawings and detailed description of the specific embodiments are not intended to limit the invention to the particular forms disclosed. On the contrary, the invention covers all modifications, equivalents and alternatives falling within the scope of the present invention as defined by the appended claims.

DETAILED DESCRIPTION

FIG. 1 illustrates a side view of an apparatus 100 for conditioning tobacco after the tobacco has been cured, but before the tobacco has been formed into bales for storage. The conditioning procedure typically last for about one day (24 hours), but may vary, e.g. from a few hours to a few days (or any suitable value according to the particular circumstances). The apparatus 100 is formed of a tobacco chamber 20 and an air processing facility 30. The air processing facility (or chamber) 30 is provided adjacent to the tobacco chamber 20 such that the tobacco chamber 20 and the air processing chamber 30 share (i.e. are separated by) a wall 26. Typically the apparatus 100 is formed as a barn or similar structure. The air processing chamber 30 may then be formed, for example, at one end of the barn, with an intervening wall inserted to separate the air processing chamber 30 from the tobacco chamber 20. Another possibility is that the tobacco chamber 20 occupies substantially all of the interior of the barn, and the air processing chamber 30 is formed in a structure immediately adjacent to (and interconnected with) the barn. In other words, the air processing chamber 30 may be part of the barn itself, or may, in effect, represent an adjunct to the barn.

In one example, the tobacco chamber 20 is typically 10 m long, 2 m wide and 1.3 m high, but the skilled person will be aware of many other possible sizings. The tobacco chamber 20 is formed of a housing containing one or more racks 22 for supporting tobacco leaves 06 that have been cured. The tobacco leaves 06 may be introduced into the apparatus 100 in the form of individual (separate) tobacco leaves, bundles of tobacco leaves or whole tobacco plants, dependent upon how the previous processing has been performed. An access door may be provided in one wall of the tobacco chamber 20 to allow tobacco 06 to be introduced and removed from the tobacco chamber 20.

The one or more racks 22 are positioned in a central portion of the tobacco chamber 20, and often extend across the entire tobacco chamber 20 to provide the maximum amount of space for the tobacco 06. Each rack 22 is typically formed of a wooden grid or mesh for supporting the tobacco 06, the mesh being sized such that the tobacco does not fall through the holes in the mesh. In alternative examples the racks 22 may be formed of a wire mesh.

The ceiling or roof of the tobacco chamber 20 includes at least one outlet or vent or hole 24 for allowing air to escape out of the tobacco chamber 20, typically into the external environment. In the example shown in FIG. 1, the ceiling includes a plurality of such holes 24. It is also possible for at least some of the holes 24 to be located on the upper portions of the walls of the tobacco chamber 20.

At least one air inlet is provided in the wall 26 separating the tobacco chamber 20 from the air processing chamber 30. The one or more air inlet(s) are positioned in the wall 26 such that they are generally below the tobacco rack(s) 22. In other words, the one or more air inlets in wall 26 open into the area between the floor and the tobacco rack(s), while the outlets 24 are provided in the ceiling above the tobacco rack(s).

In one example, the air processing chamber 30 is typically 2 m long, 0.6 m wide and 1.8 m high, but again the skilled person will be aware of many other possible sizings. The air processing chamber includes at least one air inlet 01 located in one wall of the air processing chamber 30. In the illustrated example, the air inlet 01 is located near the ceiling of the air processing chamber 30. An air outlet is provided near the base of the air processing chamber in the wall 26 adjacent to the tobacco chamber 20. In particular, this air outlet from the air processing chamber 30 connects to the corresponding air inlet into the tobacco chamber 20, thereby providing a connecting passage that allows air to pass through from the air processing chamber 30 into the tobacco chamber 20.

A temperature sensor may be provided at the air outlet of the air processing chamber 30 in order to detect the temperature of air as it passes into the tobacco chamber 20.

A ventilation system 02 is provided in the air processing chamber 30 to draw air into the air processing chamber 30 through air inlet 01 and to expel the air from the air processing chamber 30 into the tobacco chamber 20 via the air outlet in the dividing wall 26. The ventilation system 02 typically includes an electrical engine or motor and a propeller or fan arranged to push air through the air processing chamber 30.

Figure 2:
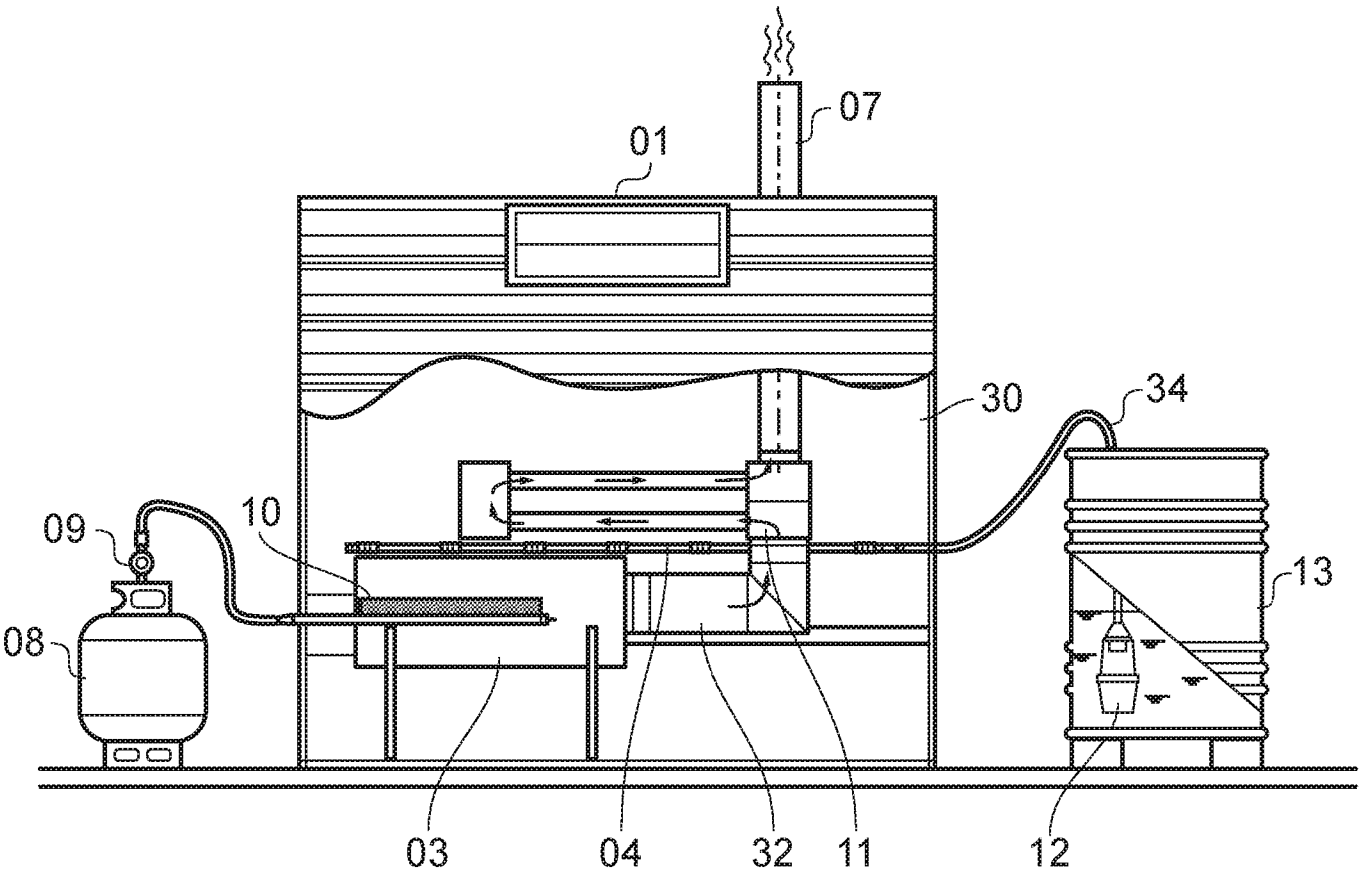
FIG. 2 is an end view of the apparatus of FIG. 1.

A heater 03 is also provided in the air processing chamber 30. As shown in FIG. 2, the heater includes a furnace 10 which is arranged to burn liquid petroleum gas (LPG), as supplied from LPG cylinder 08 via valve 09 (although other power sources, such as burning wood, could also be utilised). A duct 32 is connected to the furnace 10 to transport the fumes away from the furnace 10 to a chimney 07 which vents outside the air processing chamber 30. The chimney 07 may be located on the opposite side of the air processing chamber 30 from the air inlet 01, thereby helping to ensure that the exhaust from the chimney 07 does not contaminate the air which is flowing into the air processing chamber, and which will subsequently pass through the tobacco leaves 06.

A heat exchanger 11 is located between the duct 32 and the chimney 07. This heat exchanger comprises multiple U-shaped pipes which are connected in parallel to receive heated air and exhaust gases from the furnace 10 via duct 32. These heated gases then pass along one leg-of a U-shaped pipe before returning back to the chimney 07 along the other leg of the U-shaped pipe. By having multiple such pipes, the surface area of the heat exchanger 11 is enlarged in order to provide increased heat transfer from the heated gases produced by the furnace (and flowing in the heat exchanger pipes) to the airflow that passes the heat exchanger en route from the air inlet 01 to the air outlet into the tobacco chamber 20.

The air processing chamber 30 also includes a humidity generator 04, which is linked via a connecting pipe 34 to a water reservoir 13 and a submersion pump 12. The water reservoir 13 is provided as a source of water for providing humidity (moisture) to the tobacco leaves 06. In some implementations, the water reservoir 13 may be provided inside the air processing chamber 30, in other implementations, the water reservoir may be provided outside the air processing chamber 30 (as shown in FIG. 2). In one example, the water reservoir 13 is able to hold 220 litres of water.

A submersion pump 12 is provided in the water reservoir 13 to pump water out of the water reservoir 13, through the connecting pipe 34, and then to be dispersed via a nebuliser or atomizer nozzle(s) into the airflow through the air processing chamber 30. In other words, the atomizer nozzle is arranged to release atomized water into the air processing chamber 30 for supply into the tobacco chamber 20.

In operation, air is drawn into the air processing chamber 30 through the inlet 01 by the ventilation system 02. The ventilation then creates an airflow which passes through the air processing chamber 30 and dividing wall 26 into the lower portions of the tobacco chamber 20. In passing through the air processing chamber 30, the airflow passes both the heater 03, in particular the heat exchanger 11, and the humidity generator 04. As described in more detail below, the apparatus 100 controls the heater 03 and the humidity generator 04 to add heat and/or humidity respectively into the airflow. For example, the atomiser nozzle of the humidity generator 04 may introduce water particles into the airflow.

The airflow, with the added heat and/or moisture as appropriate, then passes out of the air processing chamber 30 into the tobacco chamber 20 through the connecting passage in the dividing wall 26. The air enters the tobacco chamber 20 below the one or more racks 22 and passes up through the holes in the rack(s) to the outlets 24 in the ceiling of the tobacco chamber 20. Note that this air therefore does not circulate within the apparatus 100, or within the tobacco chamber 20 or air processing chamber 30, but rather just makes a single pass through the apparatus 100, passing firstly through the air processing chamber 30 and then through the tobacco chamber 20 before exiting the apparatus 100.

As the air passes over the tobacco leaves 06, the tobacco leaves may be heated and/or moistened as appropriate (depending on the moisture and temperature of the air). In particular, if the airflow has added moisture, this will tend to increase the moisture level of the dried tobacco, hence making it easier to handle. Conversely, if the airflow is heated, this will tend to decrease the moisture level of the tobacco (by evaporating moisture from the tobacco).

The apparatus 100 is therefore able to maintain the tobacco leaves at a desired level of moisture (e.g. approximately 17%) by heating the airflow into the tobacco chamber 20 if the current moisture level of the tobacco leaves 06 is too high, for example when the tobacco moisture level exceeds 18%. Alternatively the apparatus is able to increase the moisture level of the tobacco leaves by adding moisture from the humidity generator if the current moisture level of the tobacco leaves 06 is too low. In this manner the apparatus is able to condition the cured tobacco to the optimum moisture level before it is baled and stored.

The assessment of the current moisture level may be made by a skilled human operator, who may then set the heater and the humidity generator to introduce heat or moisture into the airflow accordingly. Alternatively, some or all of this measurement and control procedure may be automated. For example, the tobacco chamber 20 may be provided with one or more humidity sensors (not shown in FIGS. 1 and 2) for measuring the moisture content of the tobacco leaves 06. An automated control system can then send appropriate command signals to actuate the heater 03 and/or the humidity generator 04 to introduce heat or moisture as appropriate, based on the readings from the one or more humidity sensors. Alternatively or additionally, a temperature sensor (not shown in FIG. 1 or 2) for measuring the temperature of air is provided at the inlet to the tobacco chamber 20. A controller can then send appropriate command signals to the heater 03 to increase or decrease the amount of heat introduced into the air as appropriate based on the readings of the temperature sensor (and/or humidity sensor 04 if present). The process is terminated when the tobacco leaves are considered to be at the desired moisture level.

By keeping the air at a desired moisture level between curing and baling, the apparatus 100 therefore conditions the tobacco leaves to help optimise the quality of the tobacco. In particular, the moisture level can be maintained at a level which is low enough to avoid problems such as fermentation or mould, but which is still high enough for the leaves to retain an appropriate degree of softness for ease of handling. Furthermore, by controlling the moisture level to a desired (e.g. standardised) amount, the tobacco which is input to the baling process is more consistent and predictable in terms of quality, softness, etc, which can assist in developing a more efficient and reliable baling process.

In conclusion, in order to address various issues and advance the art, this disclosure shows by way of illustration various embodiments in which the claimed invention(s) may be practiced. The advantages and features of the disclosure are of a representative sample of embodiments only, and are not exhaustive and/or exclusive. They are presented only to assist in understanding and to teach the claimed invention(s). It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope of the claims. Various embodiments may suitably comprise, consist of, or consist essentially of, various combinations of the disclosed elements, components, features, parts, steps, means, etc other than those specifically described herein. The disclosure may include other inventions not presently claimed, but which may be claimed in future.

The invention claimed is:

1. Apparatus for conditioning of tobacco leaves, the apparatus comprising:

a tobacco chamber for storing tobacco leaves, which have already been cured, for conditioning; and an air processing facility which includes: a ventilation system for creating an airflow through the apparatus, wherein said airflow is drawn into the air processing facility, passes from the air processing facility into the tobacco chamber, and subsequently exits the apparatus;

a heater for adding heat to the airflow; and a humidity generator for adding moisture to the airflow;

whereby the apparatus performs conditioning of the tobacco leaves in the chamber to a desired moisture level by using the heater to add heat to the airflow if the moisture level of the tobacco leaves in the chamber is above said desired moisture level, and to add moisture to the airflow if the moisture level of the tobacco leaves in the chamber is below said desired moisture level;

wherein the tobacco chamber comprises at least one rack on which the tobacco leaves are placed; and wherein the airflow passes once through the chamber and then exits the chamber without re-circulation.

2. The apparatus according to claim 1 wherein the ventilation system comprises a motor and fan arranged to draw air through the air processing facility.

3. The apparatus according to claim 1 wherein the heater is located upstream of the humidity generator in the air processing facility.

4. The apparatus according to claim 1 wherein the heater comprises a furnace and a heat exchanger arranged such that the furnace is configured to heat air via the heat exchanger as the air passes through the air processing facility.

5. The apparatus according to claim 1 wherein the humidity generator comprises a reservoir arranged to store water, and a pump arranged to pump water from the reservoir to an atomiser; wherein the atomiser is arranged to release water into the air processing facility prior to the air passing from the air processing facility to the tobacco chamber.

6. The apparatus according to claim 1 wherein air enters the tobacco chamber from the air processing facility below the rack.

7. The apparatus according to claim 1 wherein air exits the tobacco chamber above the rack.

8. The apparatus according to claim 1 wherein the rack is in the form of a wooden grid.

9. The apparatus according to claim 1, wherein the desired moisture level for the tobacco leaves is approximately 17-18%.

10. The apparatus according to claim 1, further comprising a controller arranged to selectively operate the heater and/or the humidity generator depending on the current tobacco moisture level.

11. The apparatus according to claim 10 wherein the controller is arranged to control the humidity generator to alter the amount of moisture introduced into the airflow in the air processing chamber depending on the tobacco moisture level.

12. The apparatus according to claim 10 wherein the controller is arranged to control the heater to increase or decrease the amount of heat introduced into the airflow in the air processing chamber depending on the tobacco moisture level.

13. The apparatus according to claim 1, further comprising a humidity sensor for measuring humidity in the chamber.

14. The apparatus according to claim 1, further comprising a temperature sensor for measuring temperature in the chamber.

* * * * *